US005720210A

United States Patent [19]

Okahashi

[11] Patent Number: 5,720,210

[45] Date of Patent: Feb. 24, 1998

[54] ROTARY CUTTER

[75] Inventor: Yoshiharu Okahashi, Takaishi, Japan

[73] Assignee: Asahi Machinery Limited, Takaishi, Japan

[21] Appl. No.: 478,596

[22] Filed: Jun. 7, 1995

[30] Foreign Application Priority Data

Oct. 17, 1994 [JP] Japan ..... 6-250655

[51] Int. Cl.[6] ..... B26D 1/62

[52] U.S. Cl. ..... 83/342; 83/344; 83/346; 83/348; 83/368; 83/698.21

[58] Field of Search ..... 83/343, 344, 346, 83/348, 368, 345, 698.21, 341, 342

[56] References Cited

U.S. PATENT DOCUMENTS

| | | | |
|---|---|---|---|
| 1,931,362 | 10/1933 | Streine | 83/346 |
| 1,931,468 | 10/1933 | Bergholtz | 83/345 X |
| 2,117,009 | 5/1938 | Paul | 83/343 X |
| 2,429,944 | 10/1947 | Rayburn et al. | 83/348 X |
| 3,186,275 | 6/1965 | Obenshain | 83/349 X |
| 3,491,641 | 1/1970 | Vandenberg | 83/346 |
| 3,989,077 | 11/1976 | Humbert | 83/698.41 |
| 4,179,958 | 12/1979 | Nomura et al. | 83/344 X |
| 4,224,848 | 9/1980 | Beerenwinkel | 83/344 X |
| 4,344,610 | 8/1982 | Jeschke et al. | 83/346 X |
| 4,355,554 | 10/1982 | Gregory, III | 83/344 X |
| 4,359,919 | 11/1982 | Fuchs et al. | 83/348 X |
| 4,372,327 | 2/1983 | Dyett et al. | 83/346 X |
| 4,548,112 | 10/1985 | Thomas | 83/345 |
| 4,553,461 | 11/1985 | Belongia | 83/346 X |
| 4,674,378 | 6/1987 | Kawano et al. | 83/368 |
| 4,726,271 | 2/1988 | McEwan | 83/346 X |
| 4,763,637 | 8/1988 | Mayer | 83/76.1 |
| 4,860,623 | 8/1989 | Pawelko | 83/346 |
| 5,174,185 | 12/1992 | Aichele | 83/346 |
| 5,363,728 | 11/1994 | Elsner et al. | 83/346 |
| 5,628,163 | 5/1997 | Keopple et al. | 83/348 X |

FOREIGN PATENT DOCUMENTS

| | | |
|---|---|---|
| 61-46277 | 10/1986 | Japan . |
| 63-57193 | 3/1988 | Japan . |

*Primary Examiner*—Eugenia Jones
*Attorney, Agent, or Firm*—Wenderoth, Lind & Ponack

[57] ABSTRACT

A rotary cutter includes a knife rotor having extending from an exterior peripheral surface thereof at least one longitudinal knife. The knife rotor cooperates to cut a sheet to a predetermined length, with either a plane rotor or a swingably mounted thick plate member, neither of which is provided with a knife. Either the plane rotor or the thick plate member has a surface positioned to come into contact with a tip of a blade of the knife to cut therebetween the sheet to a predetermined length.

15 Claims, 10 Drawing Sheets

ROTARY CUTTER

BACKGROUND OF THE INVENTION

The present invention relates to a rotary cutter for continuously cutting a paper or a cardboard to predetermined lengths.

In order to continuously cut a paper or a cardboard, conventionally rotary cutters such as disclosed in Japanese Patent Publication No. SHO61-46277 and Japanese Patent Laid-Open Publication No. SHO63-57193 have been used, for example. The principle of operation of each of these rotary cutters is that a pair of knife drums, each equipped with a knife extending in the longitudinal direction of an external circumferential surface thereof, rotate in parallel with each other at a close spacing so that a lengthy paper unwound from a feed roll device can be cut by intercrossing action of the knives, as though operating a pair of scissors.

However, all of these conventional rotary cutters still have a variety of problems as described below.

(1) Highly skilled technique is required to properly replace and adjust knives secured to the knife rotors. In addition, the knives wear quickly and must be replaced and properly adjusted frequently.

(2) Whenever the knives are adjusted, operation of the rotary cutter must be suspended. The adjustment operation consumes substantial time, and thus productivity is lessened. Furthermore, the knives are quite expensive and since they wear so quickly and have a short service life, use of such knives is by no means economical.

(3) In order to intercrossingly cut a paper with a pair of knives, positional relationship is very important. Accordingly, a pair of knife rotors must be synchronized correctly. To achieve this, the knife rotors must necessarily be driven by operating plural servo motors and non-backlash gears. Thus, the scope and cost of facilities are greatly expanded. Also, the knife rotors necessitate very complicated maintenance operations. To maintain correct positional relationship, neither positional error nor positional instability of the rotors can be allowed. Thus, extremely precise bearings are required.

(4) Since there is substantial distance between the knife rotors and corresponding feed roller units for feeding a paper thereto, the paper runs unstably, thereby resulting in lowered cutting precision. Furthermore, overall facilities including the rotary cutter occupy substantial floor space for installation, thus resulting in complicity of an overall increase of cost.

(5) Such paper cutting operation generates substantial noise.

Accordingly, the object of the invention is to provide an improved rotary cutter capable of fully solving the above problems.

SUMMARY OF THE INVENTION

To achieve the above object, the invention provides a knife rotor equipped with a plurality of knives extending in the longitudinal direction of the rotor on the external circumferential surface thereof and a plane rotor, i.e. a rotor without knives, installed at a position opposite the knife rotor, wherein an external circumferential surface of the plane rotor substantially comes into contact with tips and blades of the knives. The knife rotor continuously cuts a paper or a cardboard to a predetermined length between the hives and the external circumferential surface of the plane rotor.

Another aspect of the invention provides a knife rotor furnished with a plurality of knives extending in the longitudinal direction of the rotor on external circumferential surface thereof and a swingable thick plate member installed in opposition to the knife rotor, wherein a lateral surface of the thick plate member substantially comes into contact with tips of blades of the knives. The knife rotor continuously cuts a paper or a cardboard to a predetermined length between the lateral surface of the thick plate member and the knives. The term lateral surface designates an outer or tip surface portion of the thick plate member as viewed from the end portion at which a swingable shaft thereof is located.

The knife rotor can have an elliptic-cylindrical or a polygonal-cylindrical configuration and be equipped with the plurality of knives at positions spaced furthest from the respective elliptic-cylindrical or polygonal-cylindrical axis. Such positions of a polygonal-cylindrical knife rotor are corners thereof.

The invention further provides that the plurality of knives be spirally disposed.

The invention further provides such an improved rotary cutter furnished with a rotatable feed tool having an external circumferential surface fully covered with soft material, such feed roll being positioned immediately upstream or in front of the knife rotor and in contact with the plane rotor and parallel thereto.

The plane rotor can have an elliptic-cylindrical or a polygonal-cylindrical configuration. The paper or cardboard is cut between a lateral side portion of the plane rotor and knives of the knife rotor.

A groove may be formed to extend in the longitudinal direction of the external circumferential surface of the knife rotor for engagement therein of a knife holder. A knife holding means is secured to a knife mounting portion of the knife holder.

The knife holding means holds the knife with play.

A circumferential surface member having paper cutting surface may be formed on the circumferential surface of the plane rotor or on the lateral surface of the thick plate member. A paper or a cardboard can be cut between the paper-cutting surface of the circumferential surface member and the knives.

The knife rotor may be driven by a servo motor and the plane rotor or the thick plate member may be driven by a variable speed motor.

The improved rotary cutter may be furnished with a bearing pressurizing mechanism for energizing the shaft of the plane rotor or the thick plate member and the shaft of the knife rotor in a direction toward or a direction away from each other.

The improved rotary cutter may include a clearance detecting means for detecting a clearance between the circumferential surface of the plane rotor or the lateral surface of the thick plate member and tips of blades of knives secured to the knife rotor, and a clearance adjusting mechanism for adjusting such clearance based on data from the clearance detecting means.

The improved rotary cutter may include a bearing support mechanism, whereby an end of a bearing support of the shaft of the plane rotor or of the thick plate member rotatably supports a corresponding end of a bearing support of the shaft of the knife rotor, whereas the other end of the bearing support of the shaft of the plane rotor or of the thick plate member contractably and releasably supports a corresponding end of the bearing support of the shaft of the knife rotor via a toggle joint.

DETAILED DESCRIPTION OF THE PREFERRED EMBODIMENTS

Referring now to the accompanying drawings explanatory of embodiments of the invention, details of the inventive rotary cutter are described below.

Embodiment 1

Figure 1:
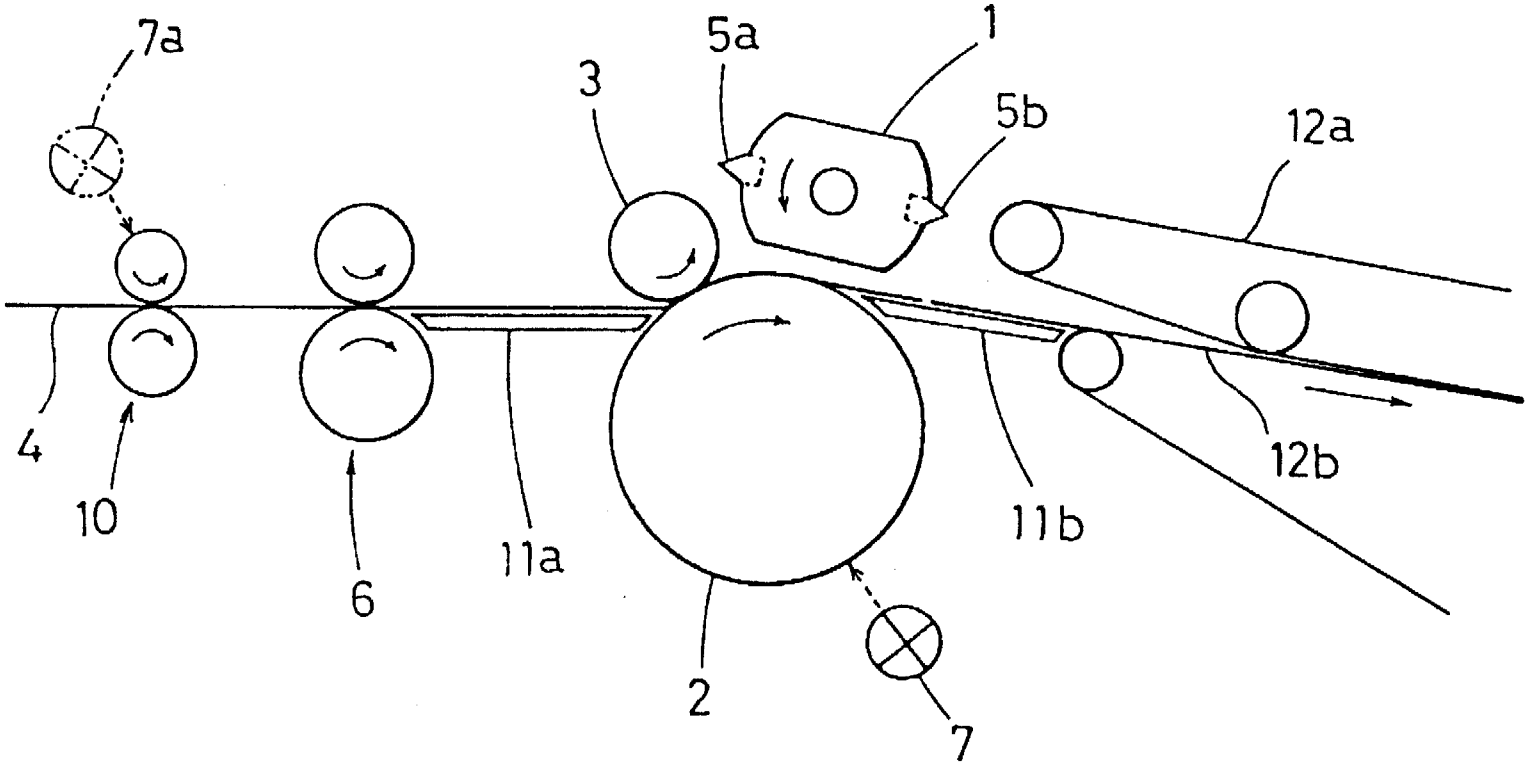
FIG. 1 is a schematic side view of a rotary cutter according to a first embodiment of the invention.
Figure 2:
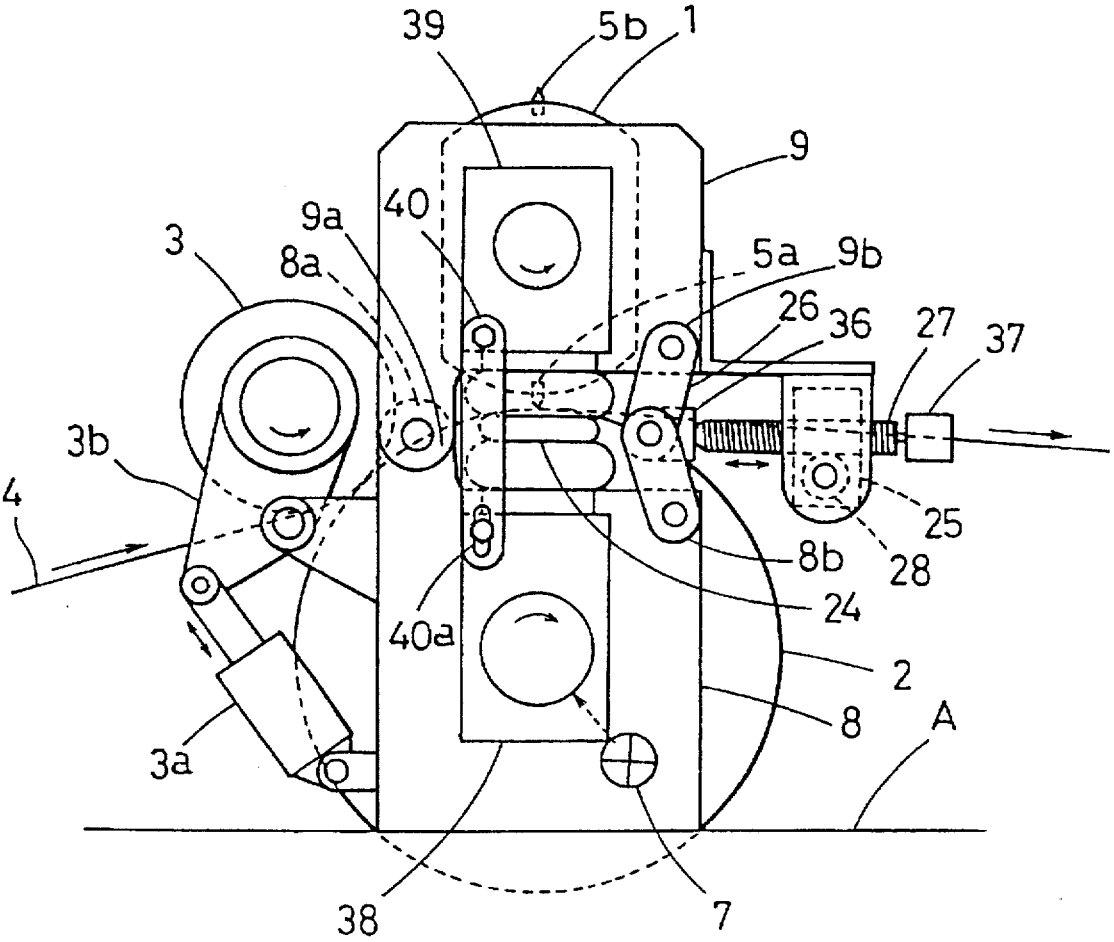
FIG. 2 is an enlarged schematic side view of the rotary cutter according to the first embodiment of the invention.
Figure 3:
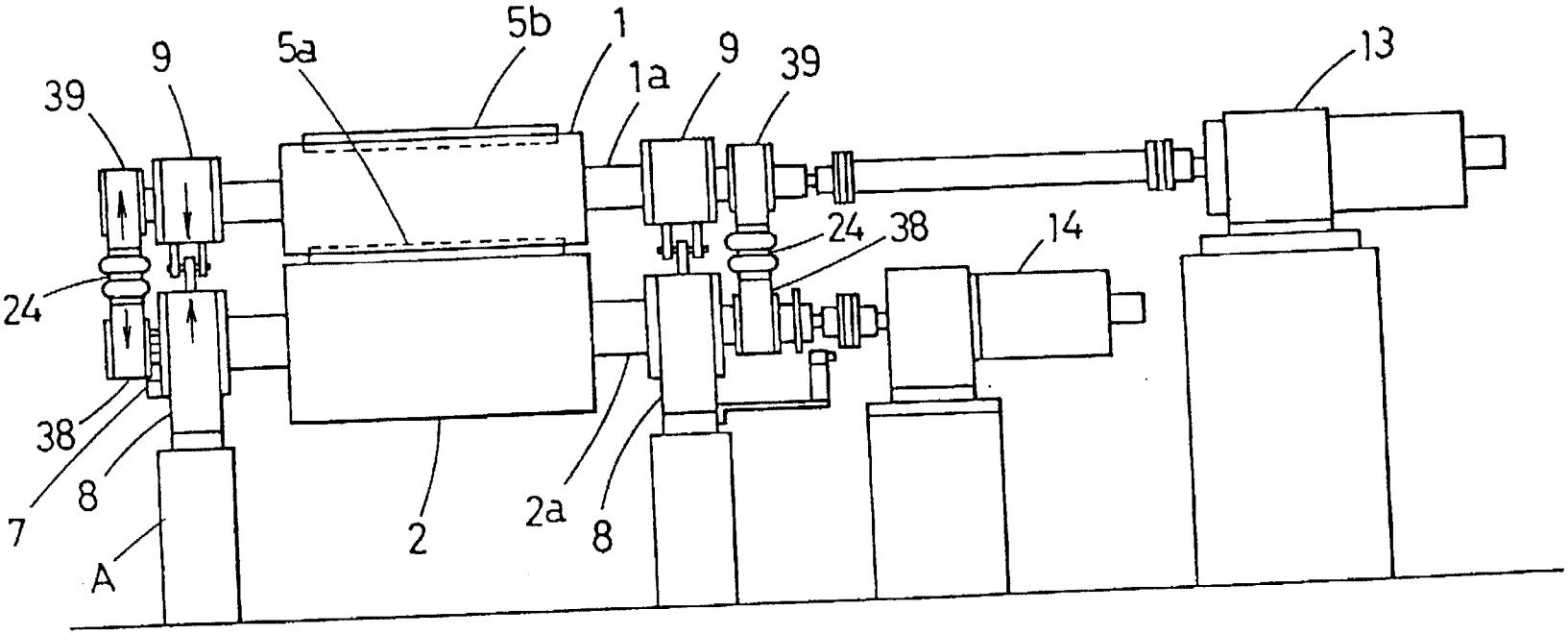
FIG. 3 is a schematic end view of the rotary cutter of FIG. 2.
Figure 4:
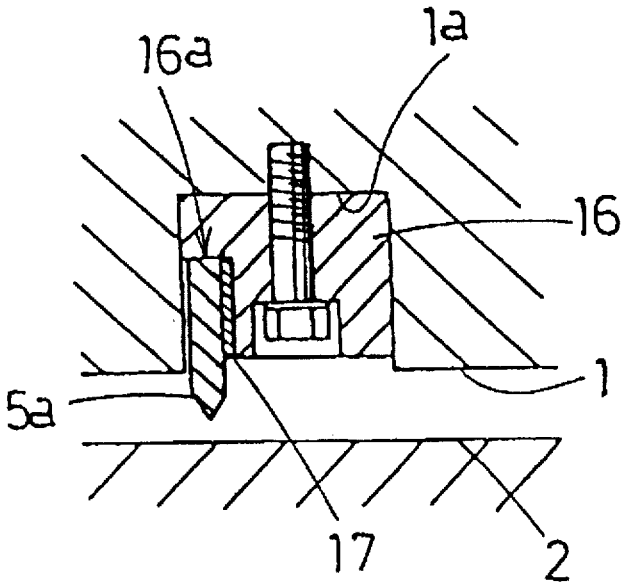
FIG. 4 is a partial sectional view of a knife rotor of the rotary cutter shown in FIG. 2.
Figure 5:
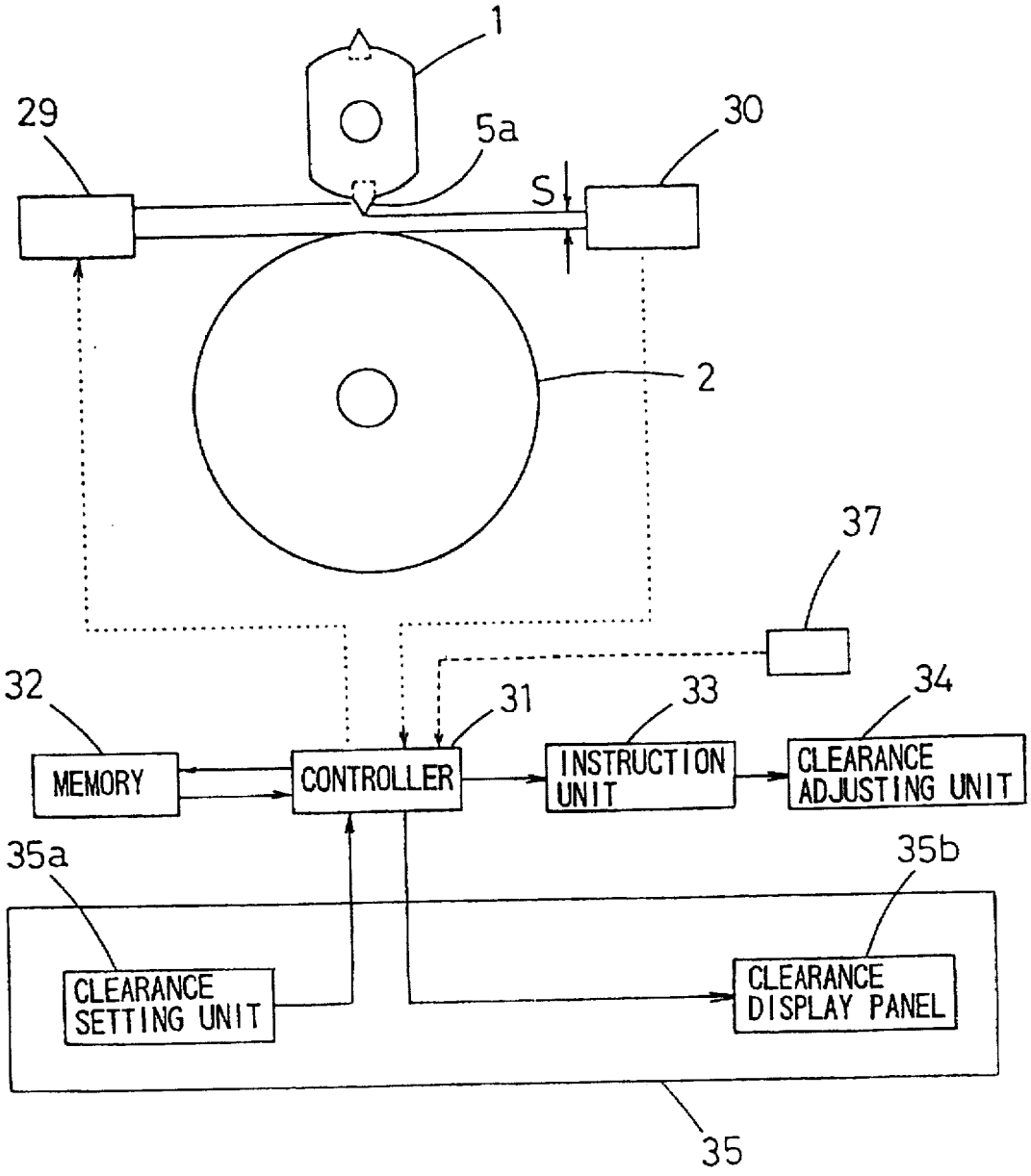
FIG. 5 is a schematic side view of a clearance adjusting mechanism of the rotary cutter shown in FIG. 2.

FIG. 1 is a schematic side view of the rotary cutter according to the first embodiment of the invention. FIG. 2 is an enlarged schematic side view of the rotary cutter of the first embodiment. FIG. 3 is a schematic end view of the rotary cutter shown in FIG. 2. FIG. 4 is a sectional view of fundamental components of the knife rotor of the rotary cutter shown in FIG. 2. FIG. 5 is a schematic view of a clearance adjusting mechanism of the rotary cutter shown in FIG. 2.

Reference numeral 1 shown in FIGS. 1, 2 and 3 designates a knife rotor provided with a pair of knives 5*a* and 5*b* on two lateral sides of an elliptic-cylindrical body. Reference numeral 2 designates a metallic plane rotor (i.e. a rotor not provided with hives) having a hard and smooth external circumferential surface. Reference numeral 3 designates a feed roll in close contact with the plane rotor at a position closely adjacent to the knife rotor 1. Reference numeral 4 designates a lengthy sheet such as paper or cardboard to be cut. Reference numeral 6 designates a slitter for adjusting the width of the sheet. Reference numeral 7 designates a rotary encoder detecting the number of rotations of the plane rotor for identifying the speed of feeding the cardboard 4. Reference numeral 8 designates a plane rotor bearing secured to a frame A. Reference numeral 9 designates a knife rotor bearing. Reference numeral 10 designates a pinch roller unit pulling the cardboard 4 at a predetermined speed. The knife rotor 1 requiring precise control of the number of rotations thereof is driven by a servo motor 13 shown in FIG. 3. On the other hand, since the circumferential rotational speed of the plane rotor 2 may substantially be identical to that of the knife rotor 1 without there necessarily being synchronization therebetween, precise control of the number of rotations of rotor 2 is not required, and thus plane rotor 2 is driven by a conventional variable-speed AC motor 14 the rotational speed of which is capable of being adjusted optionally.

It is permissible to use a conventional feed roll in place of the feed roll 3. By replacing a conventional drum-shaped knife rotor with the knife rotor i featuring the above structure and by setting the knives 5*a* and 5*b* to a preset standby position afloat the external circumferential surface of the plane rotor 2 before activating operation of the rotary cutter, a cardboard 4 can easily pass between the knife rotor 1 and the plane rotor 2, thus enabling the position of the cardboard 4 readily to be set. Whenever operating such a conventional rotary cutter by securing a plurality of knives to a single rotor, it was always difficult to properly adjust the interlocking effect therebetween. On the other hand, since the inventive rotary cutter secures a pair of knives 5*a* and 5*b* to a single knife rotor 1 without requiring difficult adjustment operations, the knife rotor i can cut a paper or a cardboard at an optional length shorter than what was normally achievable by any conventional knife rotor at the identical rotational speed. In addition, the inventive knife rotor 2 is driven by less power of the servo motor, thus making possible substantial power savings and building of the knife rotor 1 compactly. Furthermore, since the inventive knife rotor 1 is of elliptic-cylindrical shape, compared to a conventional circular-cylindrical knife rotor, the inventive knife rotor is lighter in weight and incurs less flywheel effect. Even when repeating quick acceleration and deceleration, the inventive knife rotor 1 crisply rotates to enable knives 5*a* and 5*b* to cut the paper at the exact cutting position with less power usage. As mentioned earlier, since synchronization between rotations of the plane rotor 2 and the knife rotor 1 is unnecessary, a conventional variable-speed motor of lower cost than a servo motor may be employed. Since the plane rotor 2 can be driven with a belt via an external drive source, investment cost of the rotary cutter can be reduced.

Referring now to FIG. 1, initially, a cardboard 4 is pulled by pinch roll unit 10 installed on the upstream side of feed roll unit 3. Edges of the cardboard 4 pulled from the pinch roll unit 10 are properly cut off by slitter unit 6, and then the cardboard 4 is conveyed in the direction of rotation of the plane rotor 2 after being nipped between the plane rotor 2 and the feed roll unit 3. In the meantime, while the knife rotor 1 rotates, the feed roll unit 3 is set to a position close to the knife rotor to an extent such that the knives 5*a* and 5*b* still are out of contact with the feed roll unit 3. Thus, the distance between the knife rotor 1 and the feed roll unit 3 is shortened as much as possible. This in turn causes free-run of the conveyed cardboard 4 to become extremely short, thereby stabilizing the travelling posture of the cardboard 4 pulled from the feed roll unit 3, and thereby achieving high precision in cutting of the feed roll unit 3, and thereby achieving high precision in cutting of the cardboard 4. As a result, the need for a unit for preventing the cardboard 4 from being conveyed unstably is eliminated. Since the knife rotor 1 and the feed roll unit 3 are installed adjacently on the external circumferential surface of the same plane rotor 2, provision of another feed roll unit conventionally positioned behind a guide plate 11*a* no longer is necessary. Thereby, the operating structure is simplified and the space needed for accommodating the entire structures is reduced, thus saving in investment costs.

The number of rotations of the plane rotor 2 is constantly counted by rotary encoder 7 positioned on plane rotor bearing 8. Based on data of the number of the rotations of the plane rotor 2, the operating speed of the pinch roll unit 10 for feeding a paper or cardboard 4 is properly adjusted. Simultaneously, based on the speed of rotation of the plane rotor 2, the length of the supplied cardboard 4 is computed, and then timing of activation of the knife 5*a* in the state shown in FIG. 1 for cutting the cardboard 4 is measured. Next, rotation of servo motor 13 shown in FIG. 3 is controlled to start rotation of the knife rotor 1 so that the knife 5*a* can be brought to a predetermined cutting position. In order to prevent the cardboard 4 from being torn or from slacking prepatory to the cutting operation, the speed of movement of the knife 5*a*, in other words the speed of the rotation of the knife rotor 1, is compulsorily set in perfect accord with the speed of feeding the cardboard 4.

In this way, the knife rotor 1 is rotated by operation of the servo motor 13 that is capable of correctly controlling its rotational speed, thereby enabling the knife 5*a* and the other knife 5*b* to alternately cut the cardboard 4. The thus cut-off cardboard 4 then is led to guide plate 11*b* and then conveyed forward by being nipped between conveyers 12*a* and 12*b*.

It is also permissible to drive the plane rotor 2 via a belt engaged with a conventional motor installed at a remote location. Except for the time of executing a cutting operation, the knife rotor 1 may be rotated at any speed. According to the first embodiment, while the cardboard 4 is shifted over the plane rotor 2 up to the cutting position, as shown in FIG. 1, the knife rotor 1 remains in the standby posture with the knives 5*a* and 5*b* held laterally.

In order to detect the actual speed of the cardboard 4 being fed, the speed of rotation of the pinch roll unit 10 installed on the upstream side of the feed roll 3 may be measured by means of a rotary encoder 7*a*.

Unlike any conventional synchronized flywheel cutter, the rotary cutter according to the first embodiment of the invention dispenses with a difficult adjustment operation of interlocking knives of upper and lower rotors, and thus skilled adjustment techniques are not required for maintenance.

The feed roll 3 shown in FIG. 2 is conventionally known and is rotatably held by a bearing 3*b*, wherein the other end of the bearing 3*b* is rotatably linked with a pneumatic cylinder 3*a* rotatably held by plane rotor shaft bearing 8. By effect of pneumatic force from the pneumatic cylinder 3*a*, the feed roll 3 is pressed against the external circumferential surface of the plane rotor 2. A device for supporting the feed roll 3 and fittings for installing the pneumatic cylinder 3*a* may be provided independently of the frame A. Since the feed roll 3 is rotatable relative to the rotation of the plane rotor 2, the external circumferential surface of the feed roll 3 is fully covered with soft material for preventing slippage.

As components of the bearing supporting mechanism shown in FIG. 2 and FIG. 3, one transverse side 8*a* of the plane rotor shaft bearing 8 is pivotally connected to an adjacent transverse side 9*a* of knife rotor bearing 9, whereas another transverse side 8*b* of bearing is connected to an adjacent transverse side 9*b* of the knife rotor shaft bearing 9 via a toggle joint 26.

Support bases 38 are rotatably set to both ends of an extended shaft of a plane rotor shaft 2*a*, whereas support bases 39 are rotatably set to both ends of an extended shaft of a knife rotor shaft 1*a*. Pneumatic springs 24 are secured between the upper support bases 39 and the lower support bases 38. The pneumatic springs 24 each are energized in an expansive direction. However, since the upper support bases 39 and the lower support bases 38 mutually press against each other as of the above condition to cause them to rotate themselves to inclined postures, linkage plates 40 are provided therebetween to prevent them from rotating and tilting. Upper portions of the linkage plates 40 are secured with bolts, whereas lower portions are slidably held by sliding grooves 40*a* so that the linkage plates 40 can slide solely in the vertical direction. Owing to this arrangement, the upper supporting bases 39 and the lower supporting bases shift parallel with each other. The upper supporting bases 39, the lower supporting bases 38, and the pneumatic springs 24 together form a bearing pressurizing unit or mechanism.

The bearing pressurizing unit exerts pressure against the knife rotor shaft 1*a* and the plane rotor shaft 2*a* in a direction to separate the knife rotor shaft bearing 9 from the plane rotor shaft bearing 8. However, since the knife rotor bearing 9 and the plane rotor bearing 8 are restrained by the bearing supporting mechanism, the knife rotor 1 deflects downwardly, whereas the plane rotor 2 deflects upwardly. When cutting the cardboard 4 with the knife rotor 1, since the center portion of the knife rotor 1 deflects upwardly, an uncut portion may be generated. However, owing to the downwardly deflective effect, a force is exerted against the center portion of the knives 5*a* and 5*b* to eliminate an uncut portion of the cardboard 4. Since the plane rotor 2 is downwardly deflected by its own weight, owing to the upwardly deflective effect, the posture of the plane rotor 2 is corrected.

Because of the bearing pressurizing unit, bearings accommodated in the upper support bases 39 and the lower support bases 38, the knife rotor shaft bearings 9, and the plane rotor shaft bearings 8 are respectively pressurized or urged in predetermined directions. This in turn makes it possible to restrain radial directional clearance between respective bearings and gaps between respective supporting points of the bearing supporting mechanism, thereby preventing the rotary shafts from wobbling. Because of this, conventional bearings can be employed rather than high-precision bearings, thus resulting in substantial advantages not only for manufacturing convenience, but also for maintenance operations.

It is also permissible to make use of oil pressure cylinders or coil springs in place of the pneumatic springs 24 and to directly secure pneumatic springs 24 between the knife rotor 1 and the plane rotor 2.

By turning a micrometer screw 27 secured to the toggle joint 26, a toggle step 36 can be shifted to the left or to the right as viewed in FIG. 2, thereby to vary the interval between the sides 8*b* and 9*b* of the plane rotor bearing 8 and the knife rotor shaft bearing 9.

As shown in FIG. 2, since expansive pressure of the pneumatic spring 24 as a component of the bearing pressurizing unit operates in the direction of separating the knife rotor shaft 1*a* from the plane rotor shaft 2*a*, the toggle step 36 of the toggle joint 26 constantly exerts pressure against the screw 27, thus eliminating the need to link the toggle step 36 with the screw 27. Consequently, gear box 25 can be provided independently of the toggle joint 26.

As shown in FIG. 4 (a sectional diagram), the knives 5*a* and 5*b* are respectively secured to knife mounting portions 16*a* of knife holders 16 which are respectively coupled in grooves 1*a* formed in the longitudinal direction of the knife rotor 1. Several bolts secure each knife holder 16 in position. The knife mounting portion 16*a* is a narrow or slender space formed by a cutout portion in holder 16 and a wall of the groove 1*a*. A thinly formed lengthy permanent magnet 17 is set to a wall surface adjacent the bolt, and then the knife 5a is inserted between the permanent magnet 17 and the wall of groove 1a. As a consequence, since the knife 5a is made of steel, it is attracted by the magnetic force of the permanent magnet 17. To enable play of the knife 5a, the thickness of the permanent magnet 17 is adjusted to be slightly thicker than the knife 5a. Because of this arrangement, the knife 5a is allowed to slightly move while the cutting operation is underway. It is also permissible to form the permanent magnet by use of a flexibly elastic magnetic sheet.

It is by no means necessary to employ specially adjusted expensive knives as knives 5a and 5b, but instead commercially available thin blade knives may be used. Thus, expenses of wear and tear can he reduced. Commercially available knives are finished with high precision, and thus such knives readily can be mounted securely in the knife mounting portion 16a. For example, even with positioning such a knife having a length of about two meters, such operation can be completed within 20 seconds.

An interspace between the knife 5a and the wall surface of the groove 1a is exaggeratedly illustrated in FIG. 4. However, in practice there is merely a quite narrow clearance therebetween. The knives 5a and 5b used for the inventive rotary cutter comprise conventionally known thin blades each having a maximum of 5 μm of precision in the height of the blade with a V-shaped double-edge. Not only V-shaped double-edged blades, but also linear blades, torsional blades, single-edged blades, or double-step blades can be used.

It is of course permissible to form the knife mounting portion 16a for securing the knife 5a thereto directly in the knife rotor 1 as well as to the knife holder 16. Although the knife holder is formed as a rectangular prism in this embodiment, it may also be shaped as a wedge. The permanent magnet 17 corresponds to the knife-holding means.

Referring now to FIG. 5, clearance S between the tip of the knife 5a secured to the knife rotor 1 and the external circumferential surface of the plane rotor 2 is constantly detected with extremely high precision, e.g. in units of 1 μm, by a suitable process including initial emission of light from a photo-oscillator 29 set to the plane rotor bearing 8 followed by reception of width data of light leaked through the tip of the blade of the knife 5a and the plane rotor 2 by a receiver 30 of a photo-sensor. The detected data is computed by a controller unit 31 for storage in memory 32. Simultaneously, computed data of clearance S is digitally illustrated on a clearance display panel 35b of an operation desk or panel 35.

A desired dimensional numerical value of clearance S is set by clearance setting unit 35a built in the operation desk 35. On receipt of the desired value of clearance S by the controller unit 31, instruction unit 33 transmits a control signal to a motor 28 shown in FIG. 2 (the motor 28 itself forms part of a clearance adjusting unit or mechanism 34) to activate driving of gear box 25, which then moves micrometer screw 27 back and forth. The clearance adjusting unit 34 comprises the toggle joint 26 functioning as the bearing supporting unit, the motor 28, the gear box 25 which is driven by the motor 28 and provided with high speed reduction ratio, and the micrometer screw 27 driven by the gear box 25. The photo-oscillator 29, the receiver 30, and the controller unit 31 integrally make up a clearance detecting means.

When contracting clearance S, the screw 27 is driven forward to internally push the toggle step 36 to lower the knife rotor shaft bearing 9. This in turn causes the knife rotor 1 to descend and to contract clearance S. When expanding clearance S, the screw 27 is driven backward to enable the toggle step 36 to externally emerge to cause the knife rotor 1 to ascend.

By enabling the memory 32 to previously store data of clearance S according to the type and the number of paper or cardboard prepared for cutting, owing to provision of the clearance adjusting unit 34, even when varying the type of paper or cardboard the controller 31 can immediately instruct an optimal amount of lowering of the knives. In this way, the actual clearance easily can be detected by the clearance detecting means. Even when the cutting operation is underway, the clearance optionally can be adjusted by controlling operation of the clearance adjusting unit based on the detected data.

The amount of transfer or movement of the screw 27 can be measured correctly by rotary encoder 37 secured to an end of the screw 27.

Clearance S can be adjusted very precisely by units of 1 μm in a scope ranging from −0.5 mm up to +1.5 mm on the basis of S=0 designating a position in contact with the plane rotor 2.

The sharpness of the knives and cycles of cutting during the cutting operation are encoded by the controller 31 of the clearance detecting unit for storing such data in the memory 32, thereby making it possible to identify the correct time of replacement of the knives.

Since the knife rotor 1 is disposed relative to the position of the plane rotor 2, such rotors may be disposed inversely in vertical arrangement or may be installed in a horizontal arrangement.

Embodiment 2

Figure 6:
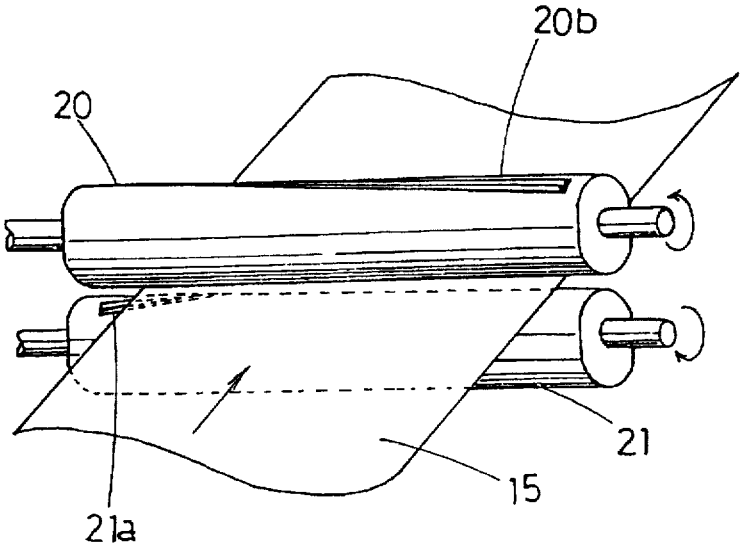
FIG. 6 is a perspective view of a rotary cutter of a second embodiment of the invention.
Figure 7:
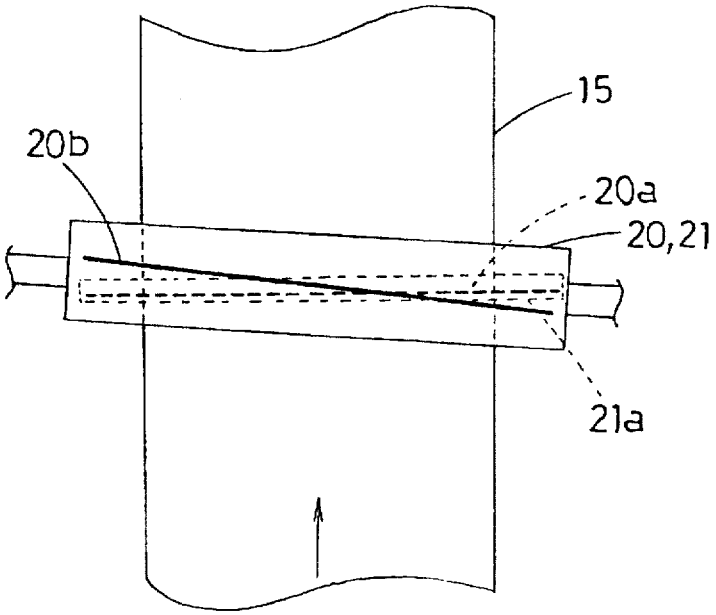
FIG. 7 is a plan view of the rotary cutter shown in FIG. 6.
Figure 8:
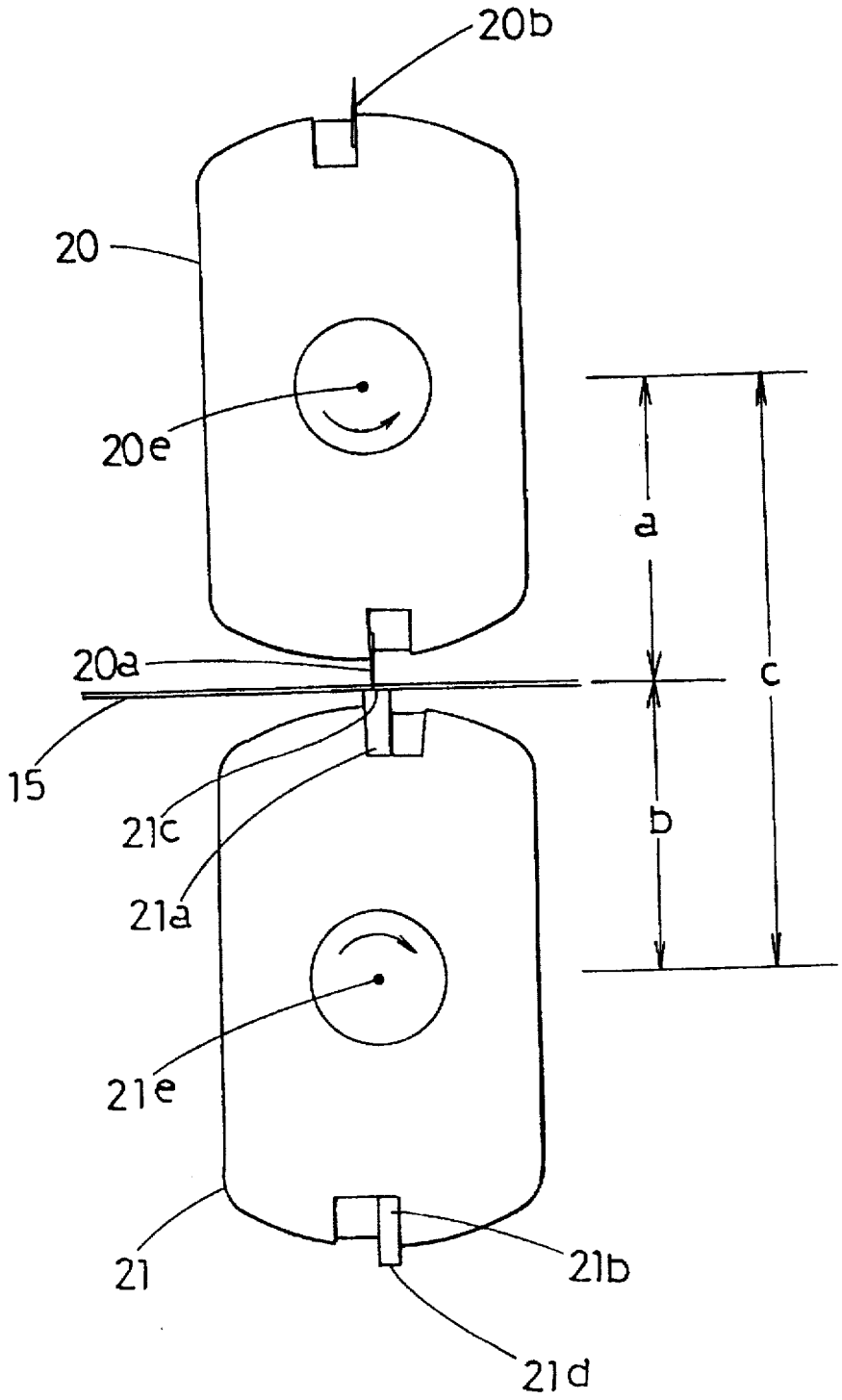
FIG. 8 is an enlarged schematic side view of the rotary cutter shown in FIG. 6.
Figure 9:
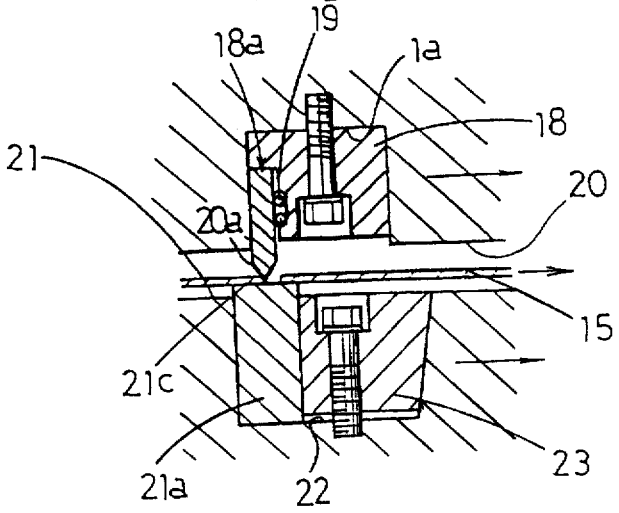
FIG. 9 is a partial sectional view similar to FIG. 4 but showing a plane rotor having a circumferential surface member.

FIG. 6 is a perspective view of a knife rotor and a plane rotor of a rotary cutter according to the second embodiment of the invention. FIG. 7 is a plane of the knife rotor and the plane rotor shown in FIG. 6. FIG. 8 is a schematic side view of the rotary cutter shown in FIG. 6. FIG. 9 is an enlarged sectional view of the cutting mechanism of the rotary cutter shown in FIG. 8.

Reference numeral 20 shown in FIGS. 6 through 8 designates the knife rotor to which a pair of knives 20a and 20b are secured to extend spirally therealong. Reference numeral 21 designates the plane rotor to which circumferential surface members 21a and 21b are secured to extend spirally therealong. Each of the knives 20a and 20b is a commercially available lengthy thin-edged knife that is secured to a knife mounting portion of a respective knife holder. Each of the circumferential surface members 21a and 21b is a prismatic metallic member having a cutting surface 21c or 21d in opposition to a knife 20a or 20b. The circumferential surface members 21a and 21b are respectively secured to positions at which the knives 20a and 20b are brought into contact with the corresponding cutting surfaces 21c and 21d while the rotary cutter rotates. Reference numeral 15 designates a rolled paper to be cut at a predetermined length.

As shown in FIG. 6, the knife rotor 20 and the plane rotor 21 respectively rotate in directions indicated by the arrows. When observing this condition by way of the plan view of FIG. 7, the knife rotor 20 and the plane rotor 21 are respectively installed without being orthogonal to the direction of feeding of the roller paper 15, but are aligned obliquely thereto in correspondence with angles of the spirally installed knives 20a and 20b and circumferential surface members 21a and 21b in order that the roller paper 15 can be cut along cut lines orthogonal to the paper feeding direction. In order to correctly set the cutting angle at a right angle or orthogonal, fine adjustment is performed by relatively varying the speed of feeding of the rolled paper 15 and the speed of rotation of the knife rotor 20 and the plane rotor 21. As the rolled paper 15 in the state shown in FIG. 7 is shifted in the direction of the arrow, the paper 15 is pressed against the cutting surface 21*c* by the knife 20*a* at a point at which the tip of the blade of the knife 20*a* comes into contact with the cutting surface 21*c*, in other words, at a point on a line interlinking rotary axes 20*e* and 21*e* of the two rotors 20 and 21, before being cut. Since the knife 20*a* and the circumferential surface member 21*a* are spirally aligned relative to the rotation of the knife rotor 20 and the plane rotor 21, the paper 15 is gradually cut from the left end at which the knife 20*a* and the circumferential surface member 21 come into contact with each other up to the right end thereof (as viewed in FIG. 7). Because of this arrangement, only a slight amount of pressing force is exerted, and yet both rotors can be driven with a relatively low amount of power. Furthermore, since the paper 15 is gradually cut, noise of cutting is minimized. The knives 20*a* and 20*b* continuously cut the rolled paper 15 at predetermined lengths while repeatedly executing the above operations in association with the circumferential surface members 21*a* and 21*b*. The paper feeding speed and the shifting speed of the hives 20*a*/20*b* and the circumferential surface members 21*a*/21*b* are adjusted to be equal to each other.

While the paper cutting operation is executed with the rotary cutter having hives 20*a*/20*b* being secured to extend spirally of the knife rotor 20 according to the second embodiment of the invention, the cutting surface 21*c* with which the roller paper 15 is brought into contact is formed on a circumferential surface having a radius equal to a distance b between the rotary axis 21*e* of the plane rotor 21 and the bottom surface of the rolled paper 15. The distance b corresponds to the result of a subtraction of distance a between the rotary axis 20*e* and the tip of the blade of the knife 20*a* from distance c between the rotary axes 20*e* and 21*e*. The width of the cutting surfaces 21*c* and 21*d* is arranged within working angles of the knives 20*a* and 20*b* while executing acceleration, the cutting operation, and deceleration. A minimum width of the cutting surfaces 21*c* and 21*d* is arranged to be ±20 mm from the paper cutting position.

Next, referring to FIG. 9, further details of the cutting operation will be described. In FIG. 9, the knife 20*a* is pressed onto a wall surface of groove 1*a* by a rubber O-ring 19 positioned at a wall surface adjacent a bolt of a knife mounting portion 18*a* of a knife holder 18. The circumferential surface member 21*a* is secured in a groove 22 formed in the longitudinal direction of the plane rotor 21 with a length pressing member 23 made from a hard plastic material. The groove 22 has tapered section, and thus fastening of bolts at several positions to secure the pressing member 23 causes the circumferential surface member 21*a* to be pressed against an opposite wall surface and to be secured firmly in the groove 22. Clearance between the tip of the blade of the knife 20*a* and the cutting surface 21*c* is finely adjusted by the clearance adjusting unit described above.

The rolled paper 15 conveyed from the left (as viewed in FIGS. 8 and 9) moves at a speed identical to the moving speed of the knife 20*a* and the circumferential surface member 21*a* before being cut. Even though the shifting movements of the knife 20*a* and the circumferential surface member 21*a* slightly differ, since the knife 20*a* slightly moves relative to the movement of the circumferential surface member 21*a* by the effect of play of the knife mounting portion, the rolled paper 15 will not be torn.

Furthermore, owing to the provision of the circumferential surface members 21*a* and 21*b*, even when the cutting surface 21*c* becomes roughened as a result of pressure from the knives 20*a*/20*b* over prolonged service, the rotary cutter can constantly maintain a sharp cutting effect merely by replacing the circumferential surface members 21*a* and 21*b*. The material of the circumferential surface members is not limited solely to metal, but hard plastic materials also may be used.

Figures 10A, 10B, 10C:
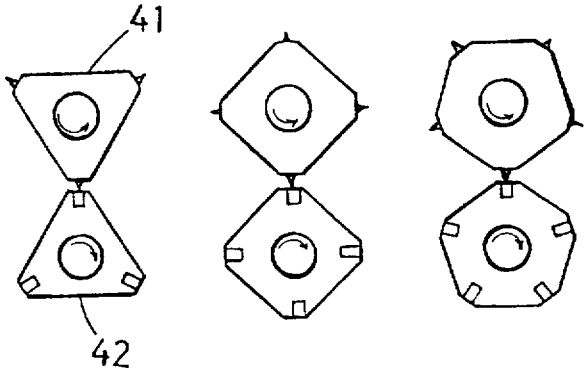
FIGS. 10(A)–10(C) are schematic views of possible alternative configurations of the knife rotor and the plane rotor.

As exemplified in the second embodiment, the shape of the plane rotor is not limited solely to a drum-shape. Furthermore, a variety of shapes can be employed for the knife rotor and the plane rotor. FIGS. 10(A) through 10(C) exemplify possible varied shapes of the knife rotor and plane rotor. The knife rotor 41 shown in FIG. 10(A) has a regular triangular section, where the three corners thereof are provided with respective knives. The plane rotor 42 corresponding to the knife rotor 41 also has a regular triangular section having circumferential surface members secured to the three corners thereof. The knife rotor and the plane rotor shown in FIG. 10(B) each have a square section. The knife rotor and the plane rotor shown in FIG. 10(C) each have regular pentagonal section. A plurality of knives are secured to the corner or summit positions of each of the knife rotors. Sectional forms are predetermined so that axes of the shapes will compulsorily pass through the centers of gravity. When the knives are spirally secured to the knife rotor, all of the knives necessarily should be secured so that the cutting surface can be brought into contact with the tips of the blades of knives in the course of rotating the plane rotor and then the knife rotor be rotated.

Embodiment 3

Figure 11:
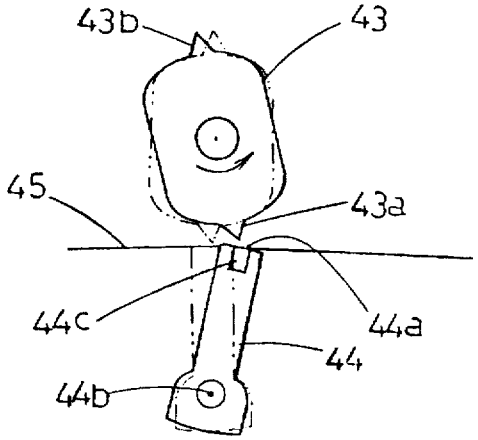
FIG. 11 is a schematic side view of a rotary cutter according to a third embodiment of the invention.

FIG. 11 is a schematic explanatory view of a rotary cutter according to the third embodiment of the invention. A knife rotor 43 provided with a pair of knives 43*a* and 43*b* is rotated in the direction of the arrow. In place of a plane rotor, a metallic thick plate member 44 having the illustrated section is provided in order that it can stably swing around a swinging shaft or axis 44*b*. Although upper and lower portions of thick plate member 44 are not symmetrically shaped, the center of gravity is above the swinging shaft 44*b*. A circumferential surface member 44*c* is inserted in an end or lateral surface 44*a* confronting the knife rotor 43 at a position such that the knives 43*a* and 43*b* respectively come into contact with member 44*c*. Reference numeral 45 designates a rolled paper to be cut.

The thick plate member 44 swings in correspondence with the movement of the tips of the blades of the knives 43*a* and 43*b* and enables the paper 45 to be cut. FIG. 11 illustrates the state immediately after cutting the paper 45. After cutting the paper 45, the knife rotor 43 rotates in the direction of the arrow. On the other hand, the thick plate member 44 shifts to the left during a period before the other knife 43*b* arrives at a paper cutting position. The thick plate member 44 then returns to the original position before execution of the cutting operation, and then enables the ensuing cutting operation upon arrival of the knife 43*b* at the cutting position. The speed of feeding of paper 45 is controlled by a feed roll unit (not shown) before determining the cutting position. The rotary cutter according to the third embodiment repeats the above sequential processes.

It is permissible to spirally secure the knives 43*a* and 43*b* to the knife rotor 43. In such case, it is essential that the thickness of the thick plate member 44 be increased, that the width of the circumferential surface member 44c be expanded or that the member 44 itself extend spirally. To implement swinging movement of the thick plate member 44, either a cam unit, a link unit, or an eccentric crank mechanism may be employed.

Embodiment 4

Figure 12:
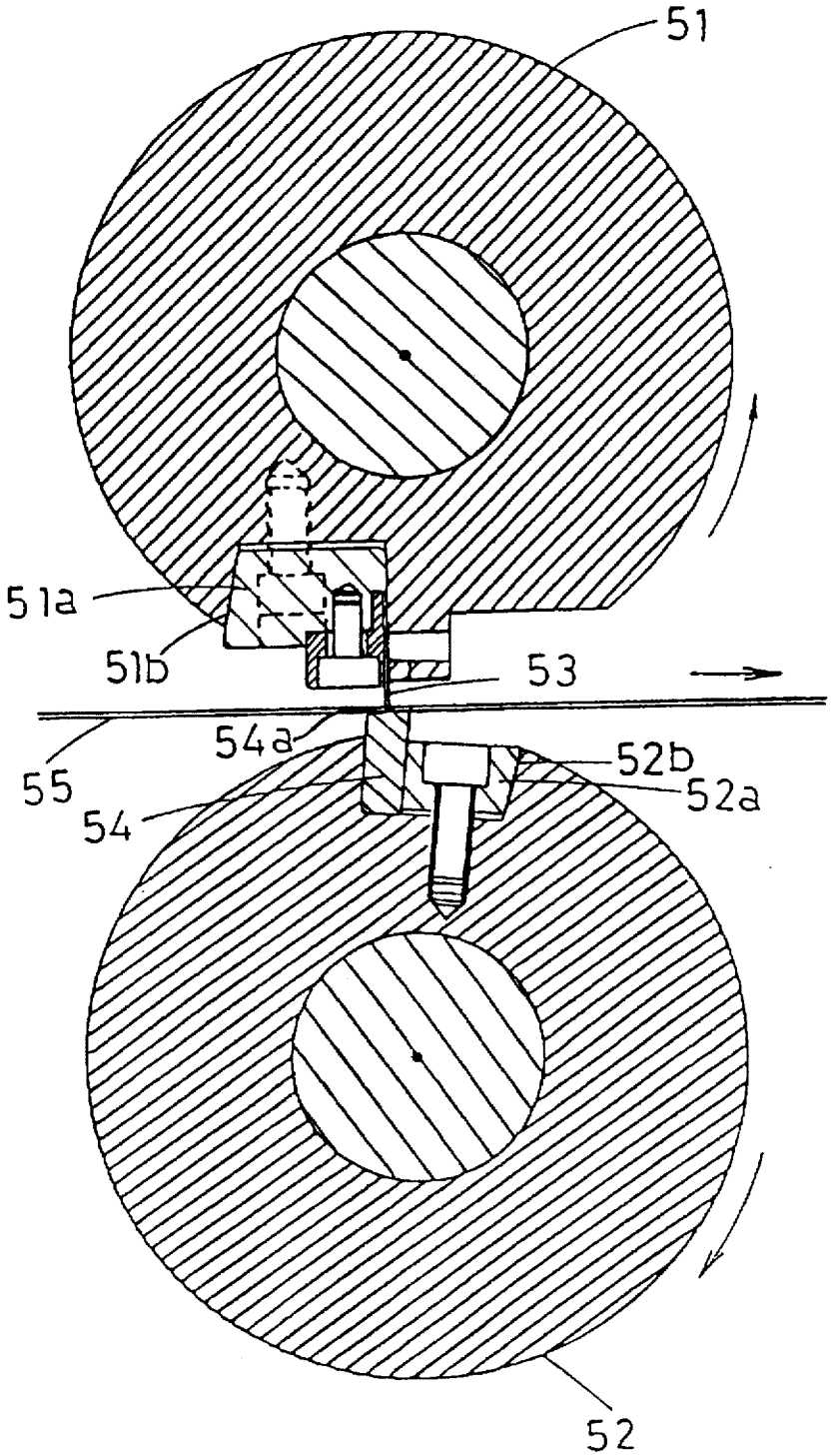
FIG. 12 is a sectional view of a knife rotor and a plane rotor of a rotary cutter according to a fourth embodiment of the invention.

The rotary cutter according to the invention also may be embodied by remodelling of a conventional synchronized flywheel cutter. FIG. 12 is a sectional diagram of a rotary cutter according to the fourth embodiment of the invention.

The rotary cutter shown in FIG. 12 comprises a knife holder 51a for securing a double-edged knife 53 thereto and a circumferential surface member holder for securing a circumferential surface member 54 thereto after disengaging knives from knife securing grooves of a top rotor 51 and a bottom rotor 52 of a conventional synchronized flywheel cutter.

The knife holder 51a is secured in a groove 51b of a knife rotor 51 (i.e. the top rotor) with screws. A commercially available lengthy dual thin-edged knife 53 is secured to the knife holder 51a. A pressing member 52a is secured in a groove 52b of a plane rotor 52 (i.e. the bottom rotor) with screws in conjunction with a circumferential surface member 54. The knife rotor 51 and the plane rotor 52 are rotated to cut a rolled paper 55 by cooperation of the dual-edged knife 53 and surface 54a of the circumferential surface member 54 respectively secured thereto.

When replacing knives, it is permissible to reserve the knife of the synchronized cutter as it was without changing the knife rotor 51 and solely to replace the knife of the plane rotor 52 with the circumferential surface member 54.

Since the conventional synchronized flywheel cutter is correctly synchronized, the knife rotor 51 and the plane rotor 52 can correctly cut the rolled paper 55 at a predetermined length. As described above, merely by replacing at least either of the knifes with the circumferential member, it is possible to easily remodel such a conventional synchronized flywheel cutter into an inventive push-type rotary cutter.

Embodiment 5

Figure 13:
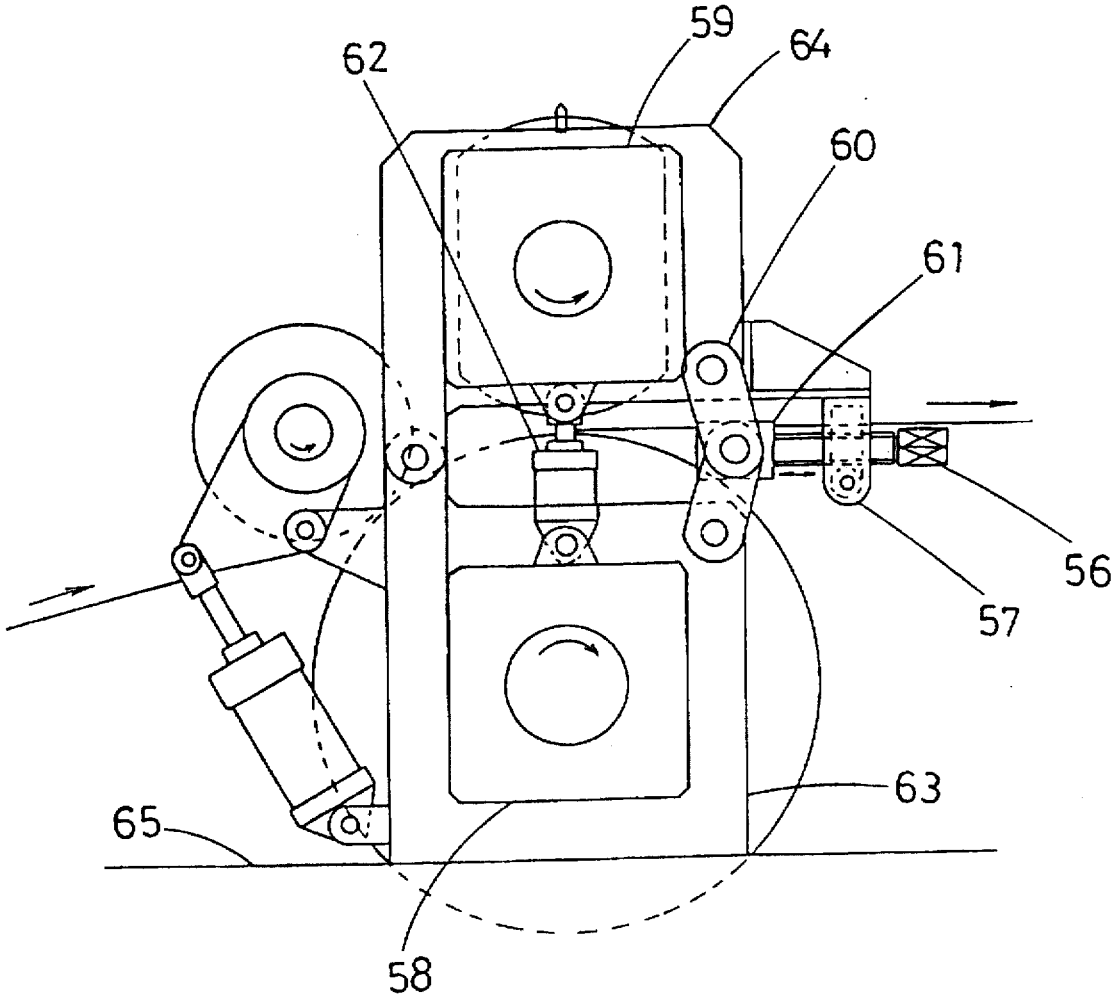
FIG. 13 is a schematic side view of a rotary cutter according to a fifth embodiment of the invention.

FIG. 13 is a schematic front view of a rotary cutter according to the fifth embodiment of the invention. Only the differences between the rotary cutter shown in FIGS. 1 and 2 and that shown in FIG. 13 are described below.

Reference numeral 62 shown in FIG. 13 designates an oil-pressure cylinder having opposite ends secured respectively to support bases 58 and 59. The oil pressure cylinder 62 exerts an energizing force in a direction of constantly bringing the two bases toward each other. The tensile strength of the oil pressure cylinder 62 can be adjusted by way of feeding and discharging oil. A screw 56 is movable back and forth by a gear box 57 in order to restrain a toggle step 61 from shifting to the right.

The oil pressure cylinder corresponds to the energizing means.

Since the oil pressure cylinder 62 constantly energizes a plane rotor shaft bearing 63 and a knife rotor shaft bearing 64 in directions toward each other, a toggle joint 60 is compressed and thus toggle step 61 is constantly urged to project to the right. Micrometer screw 56 is rotated to push a toggle step 57 to the left to stretch the toggle joint 60, thus expanding the clearance between the plane rotor shaft bearing 63 and the knife rotor shaft bearing 64.

In place of the oil pressure cylinder 62, it is permissible to use a pneumatic cylinder or a pneumatic spring or a coil spring.

The oil pressure cylinder 62 need not only act between the support bases 58 and 59. It is possible to secure an end of the oil pressure cylinder to a frame 65 to lower the set position of the support base 59 or to install the oil pressure cylinder 62 between the knife rotor shaft bearing 64 and the plane rotor shaft bearing 63.

According to the rotary cutter of the fifth embodiment, since the oil pressure cylinder 62 energizes the plane rotor, or a thick plate member, in a direction toward the knife rotor, an optimal pressing force can be set by adjusting the oil pressure. In other words, the energizing force can be adjusted depending on the type of paper. Furthermore, an intensified force is provided to properly cut the paper. In addition, since the gear box 57 is provided, both the toggle joint 60 and the screw 56 can correctly set the clearance between the tips of the blades of the knives and the circumferential surface member while the paper cutting operation is underway.

What is claimed is:

1. A rotary cutter comprising:

a knife rotor having extending from an exterior peripheral surface thereof at least one longitudinal knife;

a plane rotor having no knives and having an external surface positioned to come into contact with a tip of a blade of said knife to cut therebetween a sheet to a predetermined length;

a rotatable feed roll positioned immediately upstream of said knife rotor, relative to a sheet feed direction, said feed roll having an external circumferential surface in contact with said external surface of said plane rotor, said external surface of said feed roll being covered entirely by a soft material;

a pressurizing mechanism operatively connected to said knife rotor and to said plane rotor for urging said knife rotor and said plane rotor in first directions relative to each other;

a support mechanism operatively connected to said knife rotor and to said plane rotor for restraining relative movement between said knife rotor and said plane rotor in said first directions and for exerting pressure on said knife rotor and said plane rotor in second directions relative to each other, said second directions being opposite to said first directions; and said knife rotor including a shaft having opposite ends rotatably supported by respective bearings, said plane rotor including a shaft having opposite ends rotatably supported by respective bearings, and said support mechanism being operable between said knife rotor bearings and said plane rotor bearings, said support mechanism comprising, at each said knife rotor shaft bearing and each said plane rotor shaft bearing, a pivotable connection between a first transverse side of said knife rotor shaft bearing and an adjacent first transverse side of said plane rotor shaft bearing, and a toggle joint connection between a second transverse side of said knife rotor shaft bearing and an adjacent second transverse side of said plane rotor shaft bearing.

2. A rotary cutter as claimed in claim 1, wherein said external surface comprises a cylindrical surface of said plane rotor.

3. A rotary cutter as claimed in claim 1, wherein said exterior peripheral surface of said knife rotor is non-cylindrical and has extending therefrom plural knives, each said knife being positioned at a respective exterior peripheral surface portion spaced furthest from a center axis of said knife rotor.

4. A rotary cutter as claimed in claim 1, wherein said knife extends spirally of said knife rotor.

5. A rotary cutter as claimed in claim 1, wherein said external surface of said plane rotor is formed on a member fixed to said plane rotor.

6. A rotary cutter as claimed in claim 1, wherein said exterior peripheral surface of said knife rotor has formed therein a longitudinal groove, and further comprising a knife holder mounted within said groove, and a magnet secured to a knife mounting portion of said knife holder and magnetically attracting said knife to hold said knife in said knife holder with play.

7. A rotary cutter as claimed in claim 1, wherein said external surface of said plane rotor comprises a paper cutting surface of a circumferential surface member mounted on said plane rotor.

8. A rotary cutter as claimed in claim 1, further comprising a servomotor operably connected to said knife rotor for driving said knife rotor, and a variable speed motor operably connected to said plane rotor for driving said plane rotor independently of said knife rotor.

9. A rotary cutter as claimed in claim 1, further comprising clearance detecting means operably located for detecting a clearance between said external surface of said plane rotor and the tip of a blade of said knife, and a clearance adjusting mechanism responsive to said detecting means and operably connected to at least one of said knife rotor and said plane rotor for adjusting the clearance based on data from said detecting means.

10. A rotary cutter as claimed in claim 1, wherein said support mechanism exerts said pressure in said second directions toward each other.

11. A rotary cutter as claimed in claim 1, wherein said support mechanism exerts said pressure in said second directions away from each other.

12. A rotary cutter as claimed in claim 1, wherein said toggle joint connection is threadably adjustable.

13. A rotary cutter as claimed in claim 1, wherein said pressurizing mechanism includes respective support bases on each of said opposite ends of said knife rotor shaft and on each of said opposite ends of said plane rotor shaft, and a member operable between each said knife rotor shaft support base and an adjacent said plane rotor shaft support base.

14. A rotary cutter as claimed in claim 13, wherein said members urges said knife rotor shaft support base and said plane rotor shaft support base in said first directions away from each other.

15. A rotary cutter as claimed in claim 13, wherein said member urges said knife rotor shaft support base and said plane rotor shaft support base in said first directions toward each other.

* * * * *